US007422180B2

(12) United States Patent
Tang

(10) Patent No.: US 7,422,180 B2
(45) Date of Patent: Sep. 9, 2008

(54) MAGNETIC KNIFE STAND

(75) Inventor: Siu Nam Tang, Hong Kong (HK)

(73) Assignee: Viceversa International Limited, Hong Kong (CN)

( * ) Notice: Subject to any disclaimer, the term of this patent is extended or adjusted under 35 U.S.C. 154(b) by 0 days.

(21) Appl. No.: 11/305,015

(22) Filed: Dec. 19, 2005

(65) Prior Publication Data

US 2006/0289701 A1 Dec. 28, 2006

(30) Foreign Application Priority Data

Jun. 28, 2005 (HK) ..... 05105371.3

(51) Int. Cl.
*A47G 21/14* (2006.01)

(52) U.S. Cl. ..... 248/37.3; 248/37.6; 248/176.1; 248/206.5; 211/70.7; 30/74; 30/151; 30/298.4

(58) Field of Classification Search ..... 248/37.3, 248/37.6, 176.1, 206.5, 205.1, 309.4; 211/70.7; 30/151, 74, 298.4, 138, 152, 162, 86
See application file for complete search history.

(56) References Cited

U.S. PATENT DOCUMENTS 2,955,239 A * 10/1960 Rouse ..... 335/285
3,008,617 A * 11/1961 Villwock ..... 224/183
4,544,067 A * 10/1985 Miller ..... 211/70.6
5,011,102 A * 4/1991 Kiefer ..... 248/37.3
5,490,607 A * 2/1996 Hsieh et al. ..... 220/483
6,371,312 B1 * 4/2002 Tsuchida ..... 211/70.7
6,457,239 B1 * 10/2002 McLaughlin ..... 30/151
2002/0175131 A1 * 11/2002 Johnson ..... 211/70.7
2003/0038098 A1 * 2/2003 Stuchlik, III ..... 211/70.7

FOREIGN PATENT DOCUMENTS

JP 2001-365397 * 11/2001

OTHER PUBLICATIONS

Raffaele Iannello, DDN 1.0 Guide, Mar. 2003, Design Diffusion Edizioni srl, Milan, Italy.

* cited by examiner

*Primary Examiner*—Brian Glessner
*Assistant Examiner*—Todd M. Epps
(74) *Attorney, Agent, or Firm*—Bell, Boyd & Lloyd LLP

(57) ABSTRACT

The present invention relates to a magnetic knife stand which comprises one or more slits for inserting knives. On the upper inner side of each inserting slit, one or more magnets are disposed. A hole or a hollow is disposed on the upper inner side of each inserting holes, and the magnet is placed inside the hole or hollow on the upper inner side of the inserting slit. During and after the process of inserting the knives into the knife stand, the magnets will keep the cutting edges of the knives away from the bottom inner sides of the inserting slits, thereby effectively preventing the edges from becoming blunt, which is caused by their rubbing against the inserting slits. The frequency of sharpening the blades can be reduced and the lifespan of the knives can be extended. Further, this magnetic knife stand is more effective in protecting the knife stand from being cut or worn out by the knives. This invention enables the knives to be stored securely in the knife stand. It is convenient for use, and is safer and more reliable when used with knife sheaths.

10 Claims, 4 Drawing Sheets

MAGNETIC KNIFE STAND

BACKGROUND OF THE INVENTION

The present invention relates to a magnetic knife stand and more particularly pertains to a magnetic knife stand for storing knives.

Different kinds of knives are kept in most kitchens for preparing various dishes. Usually the knives are placed together in a knife rack or a knife stand for convenient use. The existing knife racks mainly use magnets to attract the knife blades. However, there exists a common problem that the magnetic force is likely to be too strong to make it so difficult to remove the relatively small-sized knives from the knife racks, while it is insufficient to attract and hold the relatively large-sized knives securely onto the knife racks and causes accidents easily. For the sake of safety, many kitchens use knife stands instead of knife racks. The existing knife stands comprise slits pointing substantially downwards. Knifes are inserted into the slits and stored therein for future use. The slits can be of different shapes and dimensions to match with knives of different shapes and dimensions. Knife stands can therefore be used to store the knives securely. It has the advantages of making the knives to be stored tidily and conveniently for future use. Accidents can be avoided as the cutting edges of the knives are not exposed.

However, the existing knife stands are mostly configured with the cutting edges of the knives being inserted downward. When the knife is being inserted, owing to the force of gravity the cutting edge of the knife will easily come in contact with or even rub against the bottom of the slit. The cutting edge therefore becomes blunt easily and has to be sharpened frequently, which is quite troublesome. The bottom of the knife stand also wears out, thereby shortening the lifespan of the knife stand.

BRIEF SUMMARY OF THE INVENTION

In view of the aforesaid disadvantages now present in the prior art, the object of the present invention is to provide a magnetic knife stand which is safe, reliable, convenient for use and can effectively prevent the cutting edges of the knives from becoming blunt.

To attain this, the present invention generally comprises one or more inserting slits, and one or more magnets are disposed on the upper inner side of each inserting slit; a hole or a hollow is disposed on the upper inner side of each inserting slit, and the magnet is placed inside the hole or hollow on the upper inner side of the inserting slit.

The magnet is disposed inside the inserting slit near to its opening.

One or more magnets are disposed for each inserting slit, and each magnet can be in the shape of a bar or a granule, depending on the shape, dimension and weight of the knives to be attracted.

The magnet can be adhered to or embedded into the upper inner side of the inserting slit.

Each inserting slit can have a corresponding knife sheath; the knife sheath connects to the inserting slit removably; a projecting member or a groove is provided at one end of the knife sheath which connects to the inserting slit, and a corresponding groove or projecting member is provided in the corresponding position of the inserting slit; the knife sheath can protect the cutting edge of the inserted knife and avoid accidents from happening.

The shape and dimension of the knife sheath correspond to the shape and dimension of the inserted knife.

To use the present invention, while a knife is inserting into the inserting slit of the knife stand after use, the magnet disposed on the upper inner side of the inserting slit has the property of attracting the knife, thereby keeping the upper surface of the knife (that is, the back of the blade) in contact with the upper inner side of the inserting slit while being inserted. During the process of inserting the knife, the cutting edge can be kept at a certain distance away from the bottom inner side of the inserting slit of the knife stand, thereby avoiding the cutting edge from rubbing against the bottom inner side. Further, after the knife is completely inserted into the inserting slit, the magnet can keep the cutting edge of the knife in a position of being away from and having no contact with the knife stand.

In comparison with the prior art, the present invention has the following advantages and effects:

First, since the magnet of the magnetic knife stand can keep the cutting edge of the knife away from the bottom inner side of the inserting slit during and after the process of inserting the knife into the knife stand, it can effectively prevent the cutting edge from becoming blunt, which is caused by its rubbing against the inserting slit. The frequency of sharpening the blade can then be reduced and the lifespan of the knife can be extended. Further, this magnetic knife stand is more effective in protecting the knife stand from being cut or worn out by the knives.

Secondly, this magnetic knife stand provides the inserting slits for placing the knives and magnets are disposed to attract the back of the blade. This is effective to store the knives securely in the knife stand. It is convenient for use. It is safer and more reliable when used with knife sheaths.

DETAILED DESCRIPTION OF THE INVENTION

Figure 1:
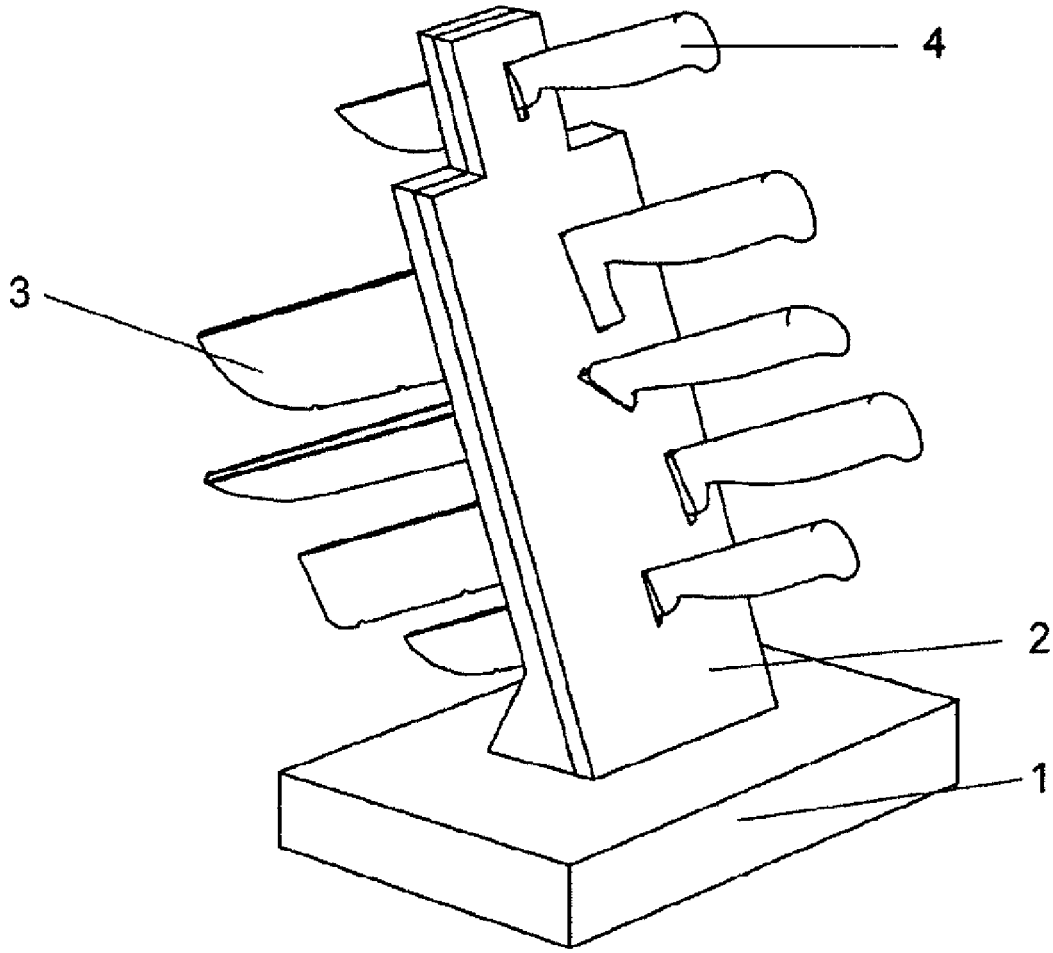
FIG. 1 shows the perspective view of the magnetic knife stand of the present invention.
Figure 2:
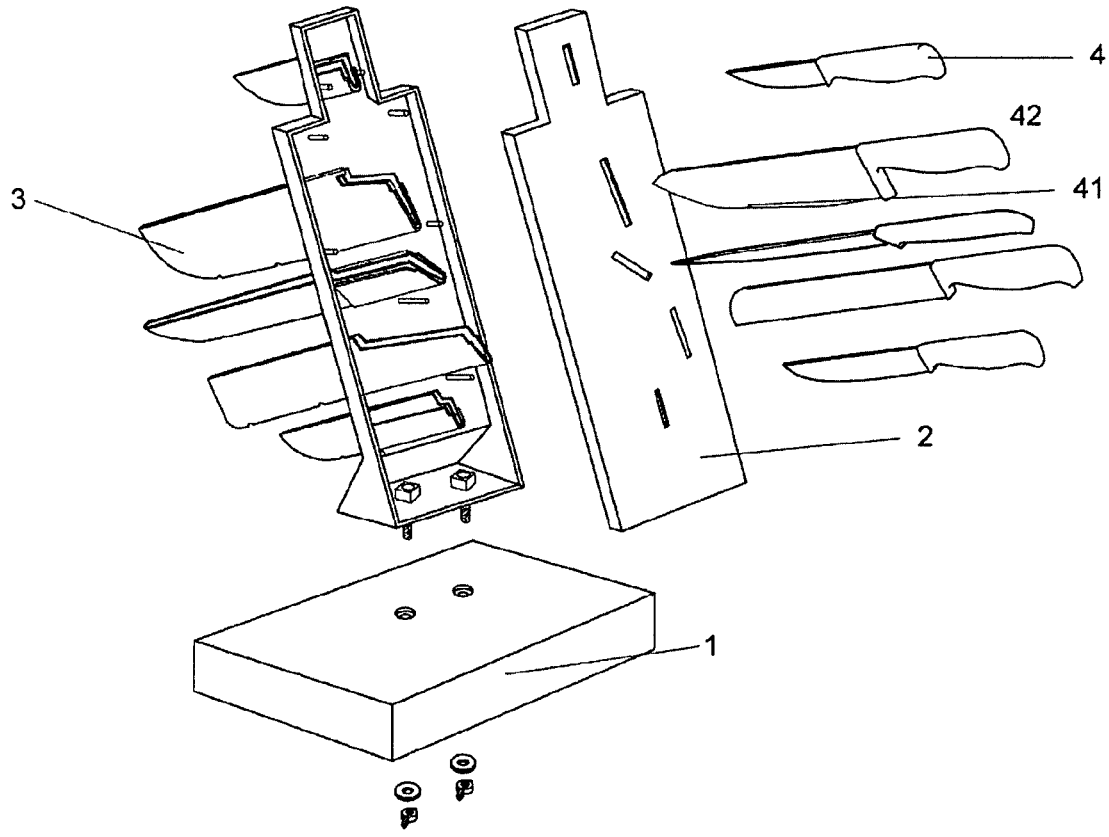
FIG. 2 is the exploded view of the magnetic knife stand as in FIG. 1.
Figure 3:
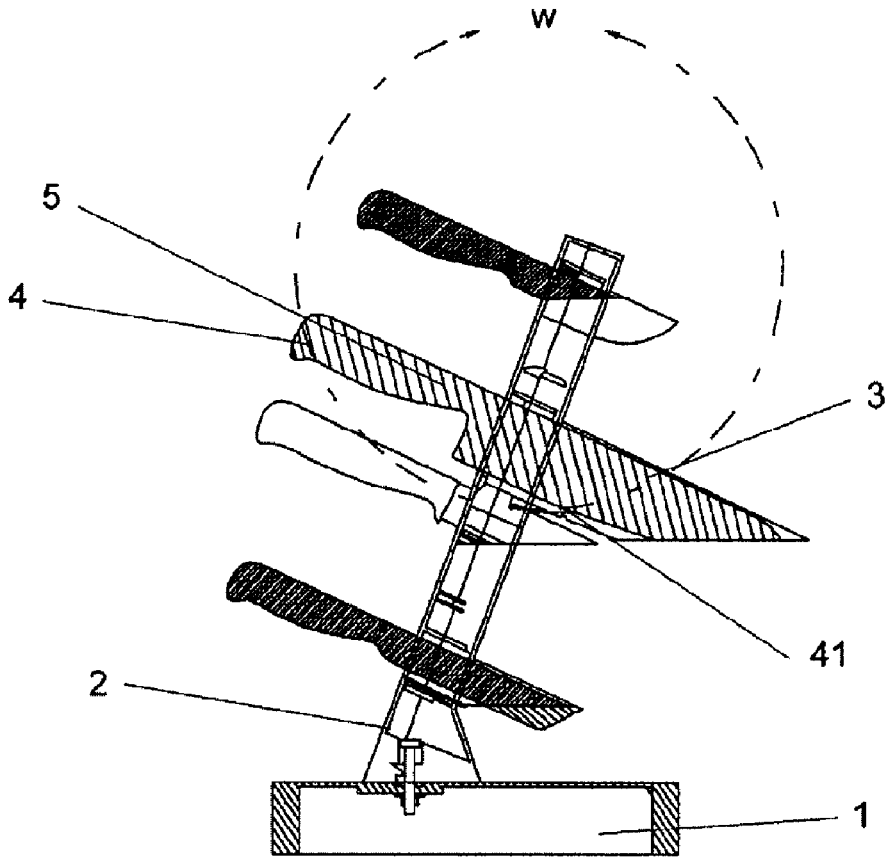
FIG. 3 shows the cross-sectional view of the magnetic knife stand as in FIG. 1.
Figure 4:
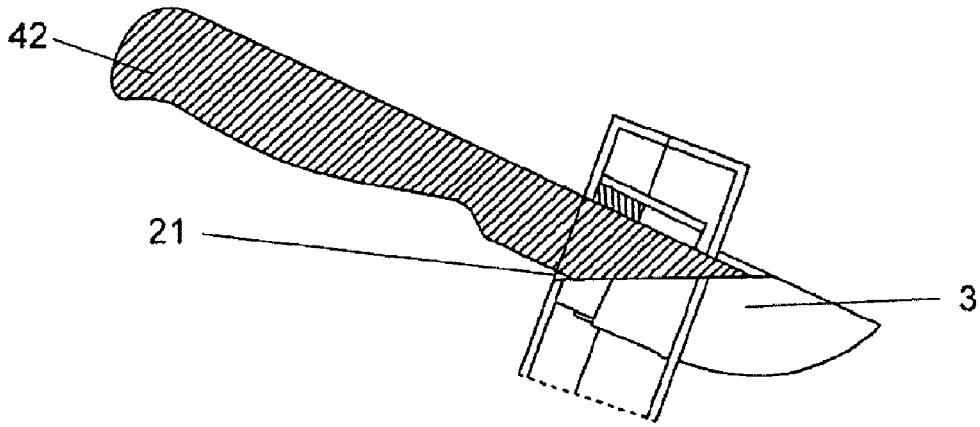
FIG. 4 shows the enlarged view of the magnetic knife stand as in FIG. 3.
Figure 5:
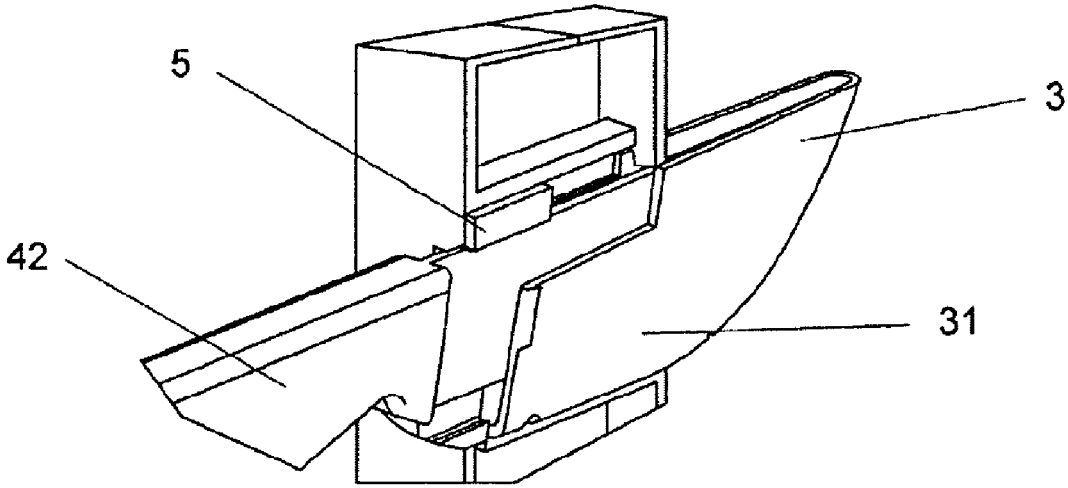
FIG. 5 is the perspective view of FIG. 4.

The present invention is further described in detail with the following embodiment and the accompanying drawings. FIGS. 1 and 2 illustrate an embodiment of this magnetic knife stand. It has an appearance of a human figure. Its appearance can be changed freely into any traditional knife stand or other appearance. As illustrated in FIGS. 1 and 2, this magnetic knife stand comprises a base 1 and a supporting stand 2. The supporting stand 2 is fixed firmly onto the base 1. As illustrated in FIG. 2, inserting slits 21 are disposed in various positions of the supporting stand 2. Magnets 5 are embedded into holes or hollows disposed on the upper inner side of the inserting slits 21 near to their openings. As illustrated in FIGS. 3 and 5, the shape of the magnets 5 is in bar form. The thickness of the magnets 5 shall not affect the insertion of knives 4. The inserting slits 21 have corresponding knife sheaths 3. One end of the knife sheaths 3 which connect to the inserting slits 21 comprises projecting members 31. The knife sheaths 3 are inserted into the supporting stand 2 by means of the projecting members 31 and connect to the inserting slits 21 correspondingly. The knife sheaths 3 can be removed conveniently when required (for example, when the knife stand has to be packed). While a knife 4 is inserting into the knife sheath 3 after use, the magnet 5 disposed on the upper inner side of the inserting slit 21 has the property of attracting the knife 4, thereby keeping the upper surface of the knife 4 (that is, the back of the blade) in contact with the upper inner side of the inserting slit 21 while being inserted. During the process of inserting, the cutting edge of the knife 4 can be kept at a certain distance away from the bottom inner side of the inserting slit 21, thereby avoiding the cutting edge from rubbing against the bottom inner side. Further, after the knife 4 is completely inserted, the magnet 5 can keep the cutting edge of the knife 4 in a position of being away from and having no contact with the bottom of the knife sheath 3. As illustrated in FIGS. 1 and 3, after the blade 41 of the knife 4 is inserted into the knife sheath 3, its handle 42 is located outside the knife sheath 3 and the supporting stand 2.

The above embodiment is a preferred embodiment of the present invention. The present invention is capable of other embodiments and is not limited by the above embodiment. Any other variation, decoration, substitution, combination or simplification, whether in substance or in principle, not deviated from the spirit of the present invention, is replacement or substitution of equivalent effect and falls within the scope of protection of the present invention.

What is claimed is:

1. A magnetic knife stand comprising:

a base;

a support attached to the base, the support including a plurality of inserting slits that are open channels formed through the support, each inserting slit including side portions, a lower inner portion and an upper inner portion, each inserting slit connected to a corresponding knife sheath having side walls, the side portions of each inserting slit corresponding to positions of the side walls of the knife sheath, and each inserting slit and corresponding knife sheath configured to receive and at least partially enclose a blade of a knife, the blade having a cutting edge, two side surfaces, and a back edge directly opposite to the cutting edge; and at least one magnet disposed on the upper inner portion of each inserting slit for attracting the back edge of the blade, and wherein a hole or a hollow is disposed on the upper inner portion of each inserting slit, and the magnet is placed inside the hole or hollow.

2. The magnetic knife stand as in claim 1, wherein the magnet is disposed inside and on the upper inner portion of the inserting slit at a position near to an opening of the inserting slit.

3. The magnetic knife stand as in claim 1, wherein at least one magnet is disposed for each inserting slit.

4. The magnetic knife stand as in claim 1, wherein the magnet is in the shape of a bar or a granule.

5. The magnetic knife stand as in claim 1, wherein the magnet is adhered to or embedded into the upper inner portion of the inserting slit.

6. The magnetic knife stand as in claim 1, wherein each knife sheath connects to the corresponding inserting slit removably.

7. The magnetic knife stand as in claim 6, wherein a projecting member or a groove is provided at one end of the knife sheath which connects to the inserting slit, and a corresponding groove or projecting member is provided in the corresponding position of the inserting slit.

8. The magnetic knife stand as in claim 6, wherein the shape and dimension of the knife sheath correspond to the shape and dimension of the knife to be inserted.

9. The magnetic knife stand as in claim 1, wherein the upper inner portion of each inserting slit corresponds to a position of the back edge of the blade when the blade is inserted into the inserting slit.

10. The magnetic knife stand as in claim 1, wherein the lower inner portion of each inserting slit is associated with a position of the cutting edge of the blade, and the side portions of the inserting slit are associated with positions of the two side surfaces of the blade when the blade is inserted into the inserting slit.

* * * * *